US012121949B2

(12) United States Patent
Okamura et al.

(10) Patent No.: US 12,121,949 B2
(45) Date of Patent: Oct. 22, 2024

(54) METHOD FOR MOLDING SCREW THREAD OF METAL PIPE

(71) Applicant: KEYLEX CORPORATION, Hiroshima (JP)

(72) Inventors: Hiroyuki Okamura, Hiroshima (JP); Ken Shimada, Hiroshima (JP)

(73) Assignee: KEYLEX CORPORATION, Hiroshima (JP)

( * ) Notice: Subject to any disclaimer, the term of this patent is extended or adjusted under 35 U.S.C. 154(b) by 272 days.

(21) Appl. No.: 17/795,533

(22) PCT Filed: Sep. 4, 2020

(86) PCT No.: PCT/JP2020/033550
§ 371 (c)(1),
(2) Date: Jul. 26, 2022

(87) PCT Pub. No.: WO2021/152896
PCT Pub. Date: Aug. 5, 2021

(65) Prior Publication Data

US 2023/0071809 A1 Mar. 9, 2023

(30) Foreign Application Priority Data

Jan. 31, 2020 (JP) ..... 2020-015083

(51) Int. Cl.
*B21D 15/04* (2006.01)
*B21D 17/02* (2006.01)
(Continued)

(52) U.S. Cl.
CPC ..... *B21D 15/04* (2013.01); *B21D 17/02* (2013.01); *B21D 41/02* (2013.01); *B21D 51/12* (2013.01); *B21D 51/38* (2013.01)

(58) Field of Classification Search
CPC ..... B21D 15/04; B21D 15/06; B21D 17/02; B21D 17/025; B21D 41/02; B21D 39/08; B21D 39/20; B21D 51/12; B21D 51/38
See application file for complete search history.

(56) References Cited

U.S. PATENT DOCUMENTS 2,476,656 A * 7/1949 Galbraith ..... B21D 15/04 285/333
5,711,177 A * 1/1998 Mitsubayashi ..... B21D 17/025 72/342.1
(Continued)

FOREIGN PATENT DOCUMENTS

JP H11-057907 A 3/1993
JP H07-164067 A 6/1995
(Continued)

OTHER PUBLICATIONS

PCT; International Search Report Issued in International Patent Application No. PCT/JP2020/033550; Mailed Oct. 6, 2020; 5 Pages Including Translation.

*Primary Examiner* — Teresa M Ekiert
(74) *Attorney, Agent, or Firm* — Procopio, Cory, Hargreaves & Savitch LLP

(57) ABSTRACT

After holding a metal pipe 10 using a clamping die 5, a primary formed portion 11*a* corresponding to the preforming surface portion 5*c* is formed on the metal pipe 10 by pressing an end portion of the metal pipe 10 with a pressing die 6 in a direction of a cylinder center line C1. A final formed portion 11*b* is formed on the metal pipe 10 by moving an outer forming die 7 to press an outer circumferential surface of the metal pipe 10 with the outer forming die 7 after aligning a rib portion 7*c* with the primary formed portion 11*a*, while moving an inner forming die 8 to press an inner circumferential surface of the metal pipe 10 with the inner
(Continued)

forming die 8 after aligning a recessed groove portion 8*c* with the primary formed portion 11*a*.

5 Claims, 9 Drawing Sheets

(51) Int. Cl.

| | |
|---|---|
| ***B21D 41/02*** | (2006.01) |
| ***B21D 51/12*** | (2006.01) |
| ***B21D 51/38*** | (2006.01) |

(56) References Cited

U.S. PATENT DOCUMENTS

| | | | | |
|---|---|---|---|---|
| 6,843,096 | B2 * | 1/2005 | Viegener ..... | B21D 41/02<br>72/370.03 |
| 2003/0126732 | A1 | 7/2003 | Okada | |
| 2011/0252852 | A1 | 10/2011 | Watabe et al. | |

FOREIGN PATENT DOCUMENTS

| | | | |
|---|---|---|---|
| JP | 4057297 | B2 | 7/2003 |
| JP | 2005-262308 | A | 9/2005 |
| JP | 4220562 | B2 | 1/2009 |
| JP | 2012-061501 | A | 3/2012 |
| WO | 2010/070980 | A1 | 6/2010 |

* cited by examiner

| | A | B | C | D | Avr | evaluation |
|---|---|---|---|---|---|---|
| a | 26.2% | 18.7% | 24.4% | 21.5% | 22.7% | ○ |
| | ○ | ○ | ○ | ○ | | |
| b | 20.8% | 20.4% | 20.4% | 23.4% | 21.2% | |
| | ○ | ○ | ○ | ○ | | |
| c | 22.5% | 22.8% | 21.4% | 26.1% | 23.2% | |
| | ○ | ○ | ○ | ○ | | |

FIG.16

| | A | B | C | D | Avr | evaluation |
|---|---|---|---|---|---|---|
| a | 23.8% | 21.6% | 23.6% | 24.4% | 23.4% | ○ |
| | ○ | ○ | ○ | ○ | | |
| b | 20.3% | 19.3% | 19.3% | 24.3% | 20.8% | |
| | ○ | ○ | ○ | ○ | | |
| c | 23.7% | 23.8% | 20.6% | 27.6% | 23.9% | |
| | ○ | ○ | ○ | ○ | | |

FIG.17

| | A | B | C | D | Avr | evaluation |
|---|---|---|---|---|---|---|
| a | 30.7% | 20.9% | 30.6% | 22.4% | 26.1% | × |
| | × | ○ | × | ○ | | |
| b | 18.3% | 17.3% | 19.3% | 26.4% | 20.3% | |
| | ○ | ○ | ○ | ○ | | |
| c | 31.8% | 22.1% | 22.6% | 31.8% | 27.1% | |
| | × | ○ | ○ | × | | |

METHOD FOR MOLDING SCREW THREAD OF METAL PIPE

CROSS REFERENCE TO RELATED APPLICATIONS

This application is the U.S. National Stage Application under 35 U.S.C. § 371 of International Application No. PCT/JP2020/033550, filed Sep. 4, 2020, designating the U.S. and published as WO2021/152896 A1 on Aug. 5, 2021, which claims the benefit of Japanese Patent Application No. JP2020-015083, filed Jan. 31, 2020. Any and all applications for which a foreign or a domestic priority is claimed is/are identified in the Application Data Sheet filed herewith and is/are hereby incorporated by reference in their entirety under 37 C.F.R. § 1.57.

TECHNICAL FIELD

The present disclosure relates to a method for forming a screw thread on a metal pipe.

BACKGROUND ART

As an usual practice, for example, a method for forming a screw thread on a metal pipe as disclosed in Patent document 1 includes providing an outer forming die and an inner forming die, the outer forming die consisting of a pair of outer split dies opposing one another, the inner forming die consisting of a pair of inner split dies corresponding to the respective outer split dies of the outer forming die, and pressing an outer circumferential surface of the metal pipe with outer forming surfaces of the outer split dies by moving the outer forming surfaces toward one another in a state where the metal pipe is placed between the outer split dies, the outer forming surfaces curved to correspond to the outer circumferential surface of the metal pipe and including a rib portion that has a shape corresponding to the screw thread, while pressing an inner circumferential surface of the metal pipe with inner forming surfaces of the inner split dies by moving the inner forming surfaces away from one another in a state where the inner split dies are inserted into the metal pipe, the inner forming surfaces including a recessed groove portion that has a shape corresponding to the screw thread and is curved to correspond to the inner circumferential surface of the metal pipe, to thereby form a helical formed part on the metal pipe between the rib portion and the recessed groove portion, the helical formed part being the screw thread.

CITATION LIST

Patent Document

[Patent Document 1] Japanese Laid-Open Patent Publication No. H11-57907

SUMMARY OF INVENTION

Technical Problem

When a screw thread is formed on a metal pipe by means of the method as disclosed in Patent document 1, a partial region of the metal pipe is highly stretched in a direction of plate thickness of the metal pipe and has significantly reduced plate thickness as compared to other regions of the metal pipe, resulting in lower strength and rigidity of the partial region. Particularly, when a fuel filling pipe is produced by means of the method as disclosed in Patent document 1, a region near one end portion of a metal pipe is subject to expansion forming and subsequently, a screw thread is formed in the expansion formed portion, thus resulting in apparently lowered rigidity and strength due to the reduced plate thickness.

The present disclosure is made in view of the foregoing and an object of the present disclosure is to reduce lowering in rigidity and strength of a metal pipe to a minimum when a screw thread is formed on the metal pipe.

Solution to Problem

To address the object, the present disclosure is characterized by carrying out, before the screw thread is formed at a predetermined location on the metal pipe, a preforming step in a region where the screw thread is to be formed.

Specifically, a method for forming a screw thread on a metal pipe in which a screw thread extending about a cylinder center line of the metal pipe is formed on the metal pipe is provided and the following aspects are then applied.

According to a first aspect of the present disclosure, the method includes holding the metal pipe using a clamping die having a clamping surface including a preforming surface portion corresponding to the screw thread, and thereafter pressing an end portion of the metal pipe with a pressing die in a direction of the cylinder center line to thereby form a primary formed portion on the metal pipe, the primary formed portion having a shape corresponding to the preforming surface portion and extending helically about the cylinder center line; and subsequently, aligning either one of a rib portion or a recessed groove portion provided on an outer forming surface of an outer forming die with the primary formed portion, the outer forming surface curved to correspond to an outer circumferential surface of the metal pipe, the rib portion or the recessed groove portion having a shape corresponding to the screw thread, and thereafter pressing the outer circumferential surface of the metal pipe with the outer forming surface by moving the outer forming die toward the cylinder center line, while inserting an inner forming die into the metal pipe and aligning another of the rib portion or the recessed groove portion provided on an inner forming surface of the inner forming die with the primary formed portion, the inner forming surface curved to correspond to an inner circumferential surface of the metal pipe, and thereafter pressing the inner circumferential surface of the metal pipe with the inner forming surface by moving the inner forming die away from the cylinder center line, to thereby form a final formed portion on the metal pipe between the rib portion and the recessed groove portion, the final formed portion serving as the screw thread.

According to a second aspect of the present disclosure which is an embodiment of the first aspect, the preforming surface portion includes a recessed strip that is open on a side corresponding to the metal pipe, and the outer forming surface of the outer forming die includes the rib portion and the inner forming surface of the inner forming die includes the recessed groove portion.

According to a third aspect of the present disclosure which is an embodiment of the second aspect, the preforming surface portion includes a pair of inclined side surface portions and a curved surface portion, the pair of inclined side surface portions extending away from the outer circumferential surface of the metal pipe held by the clamping die and opposing one another to be progressively closer to one another as extending away, the curved surface portion belt-shaped to connect extension ends of the inclined side surface portions and gently curved such that its midsection in a width direction is located on a metal pipe side.

According to a fourth aspect of the present disclosure which is an embodiment of the first aspect, the preforming surface portion includes a rib protruding on a side corresponding to the metal pipe, and the outer forming surface of the outer forming die includes the rib portion and the inner forming surface of the inner forming die includes the recessed groove portion.

According to a fifth aspect of the present disclosure which is an embodiment of any one of the first to fourth aspects, the outer forming die includes a pair of outer split dies movable toward and away from one another, and the outer split dies have a length more than or equal to one-fourth of a circumference of the metal pipe, and the inner forming die includes a pair of inner split dies being movable toward and away from one another and corresponding to the respective outer split dies, and the method further includes, after placing the metal pipe between the outer split dies, pressing the outer circumferential surface of the metal pipe with outer forming surfaces of the outer split dies by moving the outer split dies toward one another while pressing the inner circumferential surface of the metal pipe with inner forming surfaces of the inner split dies by moving the inner split dies away from one another and thereafter, rotating the metal pipe by 90 degrees about the cylinder center line, and subsequently, pressing the outer circumferential surface of the metal pipe with the outer forming surfaces of the outer split dies by moving the outer split dies toward one another while pressing the inner circumferential surface of the metal pipe with the inner forming surfaces of the inner split dies by moving the inner split dies away from one another, to thereby form the final formed portion.

Advantageous Effects of Invention

In the first aspect of the present disclosure, the pressing movement of the pressing die applies compression force to the metal pipe in the direction of the cylinder center line and thus, a portion of the metal pipe, which corresponds to the preforming surface portion and in which the screw thread is to be formed, is deformed inwardly or outwardly of the metal pipe while retaining its plate thickness, in order to provide the primary formed portion. Even when the primary formed portion of the metal pipe is deformed thereafter by the rib portion and the recessed groove portion corresponding to one another, an amount of stretch of the primary formed portion of the metal pipe in a direction of the plate thickness until the primary formed portion is processed to be the final formed portion is thus decreased, reducing lowering in rigidity and strength due to decreased plate thickness to a minimum.

In the second aspect of the present disclosure, a direction of deformation of the primary formed portion formed by the preforming surface portion and a direction of deformation of the final formed portion are opposite, thus canceling residual stresses on the portions to provide good formability. The primary formed portion of the metal pipe is thus easier to deform, enabling avoidance of, for example, cracking during the forming to unfailingly form the screw thread.

In the third aspect of the present disclosure, the primary formed portion formed by the preforming surface portion has a substantially triangular cross section and a tip portion of the primary formed portion has an indentation. When the outer forming die is moved toward the metal pipe after forming the primary formed portion, the rib portion thus fits in the tip portion of the primary formed portion. This reduces variations in forming operation, enabling the shape of the final formed portion to be formed with good precision.

In the fourth aspect of the present disclosure, a direction of deformation of the primary formed portion formed by the preforming surface portion and a direction of deformation of the final formed portion are the same. Thus, when the primary formed portion is deformed into the final formed portion between the rib portion of the outer forming die and the recessed groove portion of the inner forming die, force applied to the metal pipe can be reduced as compared to that of the arrangement as in the second aspect, enabling improvement of processing efficiency.

In the fifth aspect of the present disclosure, even when the screw thread is shaped to extend helically more than or equal to half of the circumference of the metal pipe about the cylinder center line, the screw thread can be formed by the pairs of outer forming dies and inner forming dies, without having multiple forming operations. This enables a low-cost and efficiently forming arrangement.

BRIEF DESCRIPTION OF DRAWINGS

FIG. 16 is a table showing results of studying a rate of decrease of plate thickness for a screw thread of a metal pipe formed by means of a method according to the second embodiment.

FIG. 17 is a table showing results of studying a rate of decrease of plate thickness for a screw thread of a metal pipe formed by means of a conventional method.

DESCRIPTION OF EMBODIMENTS

Embodiments of the present disclosure are described in detail below with reference to the drawings. It is noted that the following description of preferred embodiments is merely an example in nature.

First Embodiment of Disclosure

Figure 1:
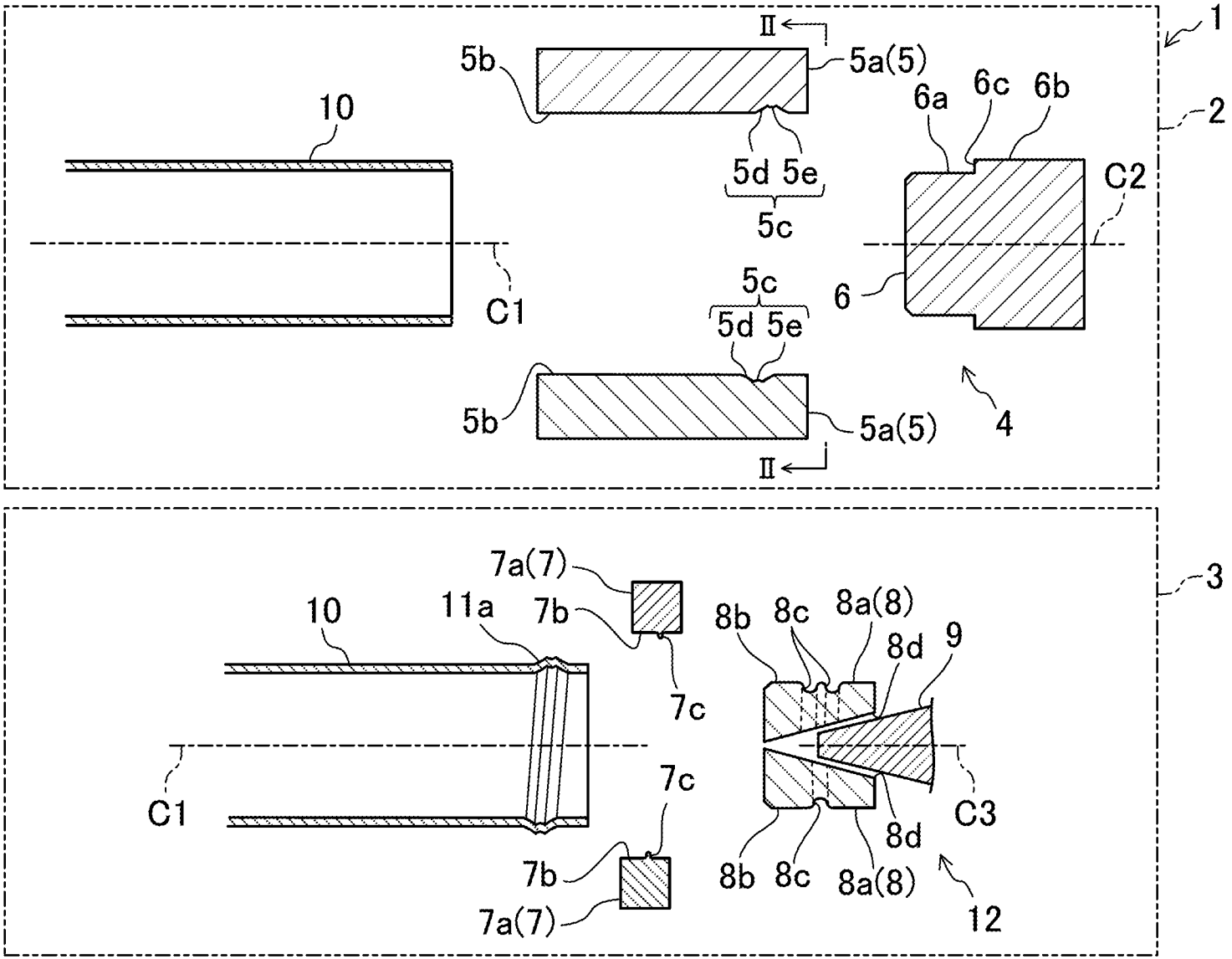
FIG. 1 is a schematic cross-sectional view illustrating a forming apparatus for forming by means of a method according to a first embodiment of the present disclosure.
Figure 2:
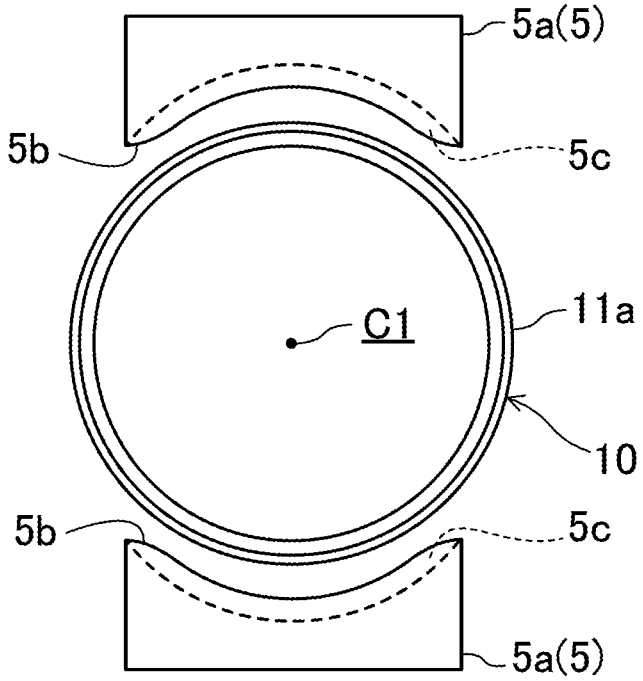
FIG. 2 is a cross-sectional view taken along a plane II-II indicated in FIG. 1.

FIG. 1 is a schematic cross-sectional view illustrating a forming apparatus 1 for forming by means of a method according to a first embodiment of the present disclosure. The forming apparatus 1 is installed in a production line for a fuel filling pipe (not shown) incorporated in a vehicle, and is used for forming a screw thread 11 on a metal pipe 10. The forming apparatus 1 includes a first forming operation section 2 for forming a primary formed portion 11*a* on the metal pipe 10 and a second forming operation section 3 for forming a final formed portion 11*b* on the metal pipe 10, in that order from an upstream end of the production line. The screw thread 11 then includes a rib protruding inwardly of the metal pipe 10 on an inner circumferential surface of the metal pipe 10 and extending helically, substantially around a circumference of the metal pipe 10, about a cylinder center line C1, and is also shaped to be open on an outer circumferential surface side of the metal pipe 10 (see FIG. 10).

The first forming operation section 2 includes a first forming unit 4 including a clamping die 5 for holding the metal pipe 10 and a pressing die 6 for pressing the metal pipe 10.

The clamping die 5 includes a pair of clamping split dies 5*a* movable toward and away from one another. A clamping surface 5*b* of each of the clamping split dies 5*a* is curved to correspond to the outer circumferential surface of the metal pipe 10.

A preforming surface portion 5*c* is formed on the clamping surface 5*b* at a predetermined position and includes a recessed strip that is open on a side corresponding to the metal pipe 10.

As shown in FIGS. 2 to 6, the preforming surface portion 5*c* includes a pair of inclined side surface portions 5*d* and a curved surface portion 5*e*, the pair of inclined side surface portions 5*d* extending away from the outer circumferential surface of the metal pipe 10 held by the clamping die 5, and opposing one another to be progressively closer to one another as extending away, the curved surface portion 5*e* belt-shaped to connect extension ends of the inclined side surface portions 5*d* and gently curved such that its midsection in a width direction is located on a metal pipe 10 side.

The pressing die 6 has a short, substantially cylindrical shape and is capable of moving forward and rearward in a direction of a center line C2.

The pressing die 6 includes an insertion portion 6*a* in a front portion thereof in the forward and rearward movement direction, the insertion portion 6*a* having an outer diameter smaller than an inner diameter of the metal pipe 10; a base portion 6*b* that is a portion of the pressing die 6 other than the insertion portion 6*a*, the base portion 6*b* having an outer diameter larger than an outer diameter of the metal pipe 10; and a pressing portion 6*c* including a stepped portion extending annularly about the center line C2 between the insertion portion 6*a* and the base portion 6*b*.

When the metal pipe 10 is held by the clamping split dies 5*a* of the clamping die 5, the cylinder center line C1 of the metal pipe 10 is aligned with the center line C2 of the pressing die 6. The forward movement of the pressing die 6 then allows the insertion portion 6*a* of the pressing die 6 to be inserted into the metal pipe 10, and the pressing portion 6*c* to press an end portion of the metal pipe 10 in a direction of the cylinder center line C1. A side wall of the metal pipe 10 that is pressed by the pressing portion 6*c* is then deformed into a shape conforming to the preforming surface portion 5*c* and the primary formed portion 11*a* extending helically about the cylinder center line C1 is formed on the metal pipe 10.

The second forming operation section 3 includes a secondary forming unit 12 including: an outer forming die 7 having a pair of outer split dies 7*a* movable toward and away from one another; an inner forming die 8 having a pair of inner split dies 8*a* being movable toward and away from one another and corresponding to the respective outer split dies 7*a*; and slider die 9 having a truncated pyramid shape and being slidable in a direction orthogonal to a direction where the inner split dies 8*a* are arranged in parallel.

Figure 7:
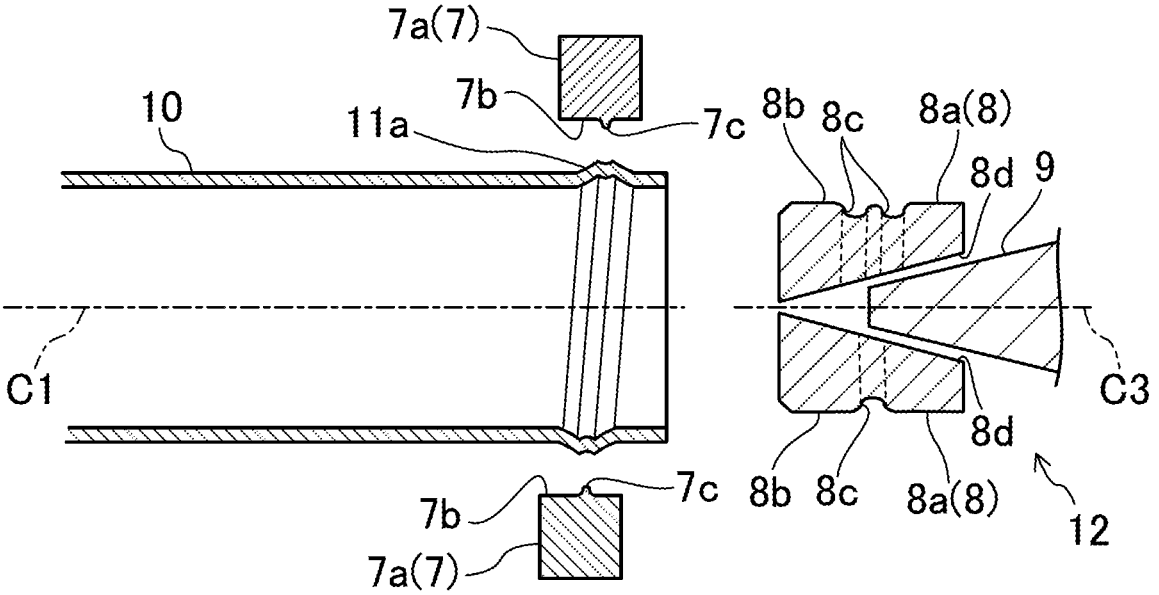
FIG. 7 is a cross-sectional view illustrating a state immediately before forming a final formed portion on the metal pipe in a second forming operation section, after the state shown in FIG. 6.
Figure 8:
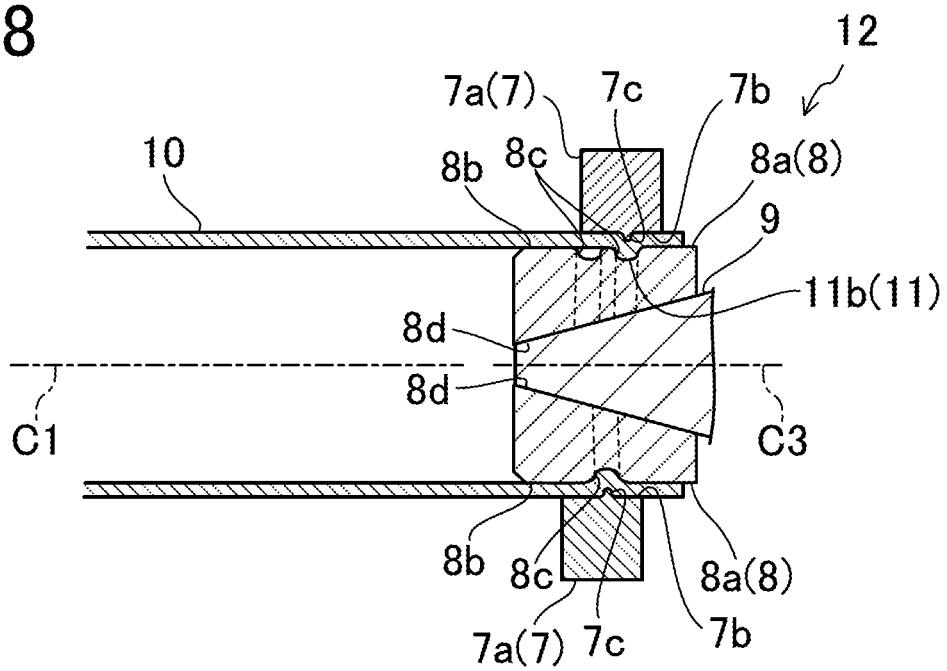
FIG. 8 is a cross-sectional view illustrating a state in the midst of forming the final formed portion on the metal pipe in the second forming operation section, after the state shown in FIG. 7.

The outer split dies 7*a* have a length more than or equal to one-fourth of the circumference of the metal pipe 10. As shown in FIGS. 7 and 8, the outer split dies 7*a* include respective outer forming surfaces 7*b* opposing one another and curved to correspond to the outer circumferential surface of the metal pipe 10.

The outer forming surfaces 7*b* each include a rib portion 7*c* having a shape corresponding to the screw thread 11.

When the outer split dies 7*a* are then moved toward one another in a state where the metal pipe 10 is placed between the outer split dies 7*a* and the rib portions 7*c* of the outer forming surfaces 7*b* are each aligned with the primary formed portion 11*a*, the outer circumferential surface of the metal pipe 10 is pressed by the outer forming surfaces 7*b* of the outer split dies 7*a*.

The inner split dies 8*a* have a dimension corresponding to the outer split dies 7*a* and the inner split dies 8*a* include respective inner forming surfaces 8*b* opposing one another and curved to correspond to the inner circumferential surface of the metal pipe 10.

The inner forming surfaces 8*b* each include a recessed groove portion 8*c* having a shape corresponding to the screw thread 11, and a cross section of the recessed groove portion 8*c* is substantially bowl-shaped.

An inner forming surface 8*b* of one of the inner split dies 8*a* includes a pair of recessed groove portions 8*c* arranged in parallel and an inner forming surface 8*b* of another of the inner split dies 8*a* includes one recessed groove portion 8*c*.

The inner split dies 8*a* include respective cam surfaces 8*d* on surfaces thereof opposing one another, and the cam surfaces 8*d* have a curved shape in a cross sectional view to correspond to an outer circumferential surface of the slider die 9 and are inclined to be progressively closer to one another toward one end along the direction orthogonal to the direction where the inner split dies 8*a* are arranged in parallel. The slider die 9 is located between the cam surfaces 8*d*.

The slider die 9 has its center line C3 aligning with the cylinder center line C1 of the metal pipe 10 when the metal pipe 10 is placed in the secondary forming unit 12.

When the slider die 9 is then slid into the metal pipe 10 along a direction of the center line C3 in a state where the inner split dies 8*a* and the slider die 9 are inserted in the metal pipe 10 and one of the recessed groove portions 8*c* of the one of the inner split dies 8*a* and the recessed groove portion 8*c* of the other of the inner split dies 8*a* are each aligned with the primary formed portion 11*a*, the outer circumferential surface of the slider die 9 is in sliding contact with the cam surfaces 8*d* of the inner split dies 8*a* to move the inner split dies 8*a* to be spaced away from one another. This spacing movement of the inner split dies 8*a* causes the inner forming surfaces 8*b* of the inner split dies 8*a* to press the inner circumferential surface of the metal pipe 10. Thus, the movement of the outer split dies 7*a* toward the cylinder center line C1 causes the outer forming surfaces 7*b* to press the outer circumferential surface of the metal pipe 10 and the movement of the inner split dies 8*a* away from the cylinder center line C1 causes the inner forming surfaces 8*b* to press the inner circumferential surface of the metal pipe 10. Thereby, part of the final formed portion 11*b* is formed on the metal pipe 10 between the rib portions 7*c* and the corresponding recessed groove portions 8*c*, the part of the final formed portion 11*b* included in the screw thread 11 extending helically, approximately around the circumference, about the cylinder center line C1.

Figure 9:
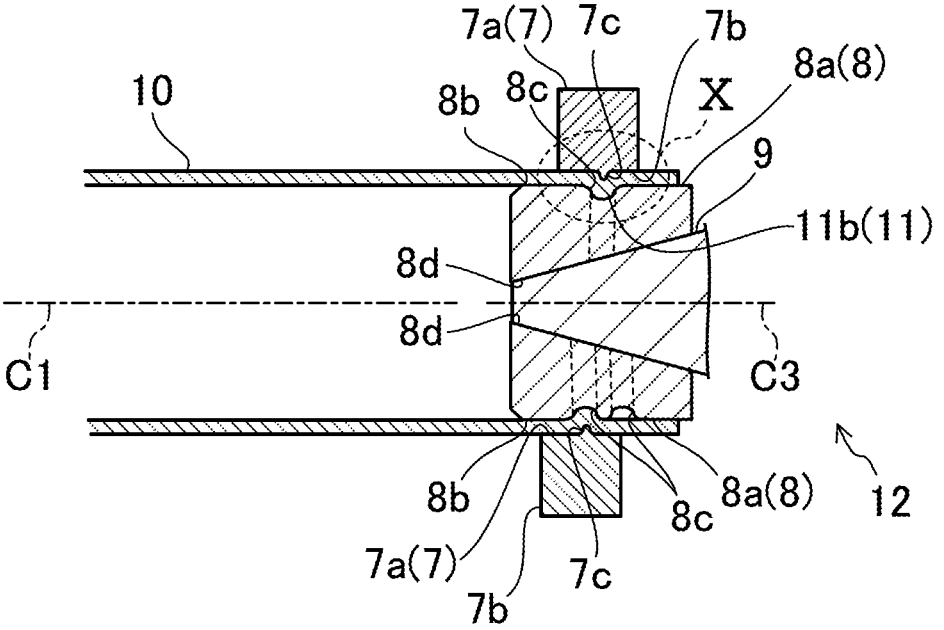
FIG. 9 is a cross-sectional view illustrating a state immediately before finishing forming the final formed portion on the metal pipe in the second forming operation section, after the state shown in FIG. 8.
Figure 10:
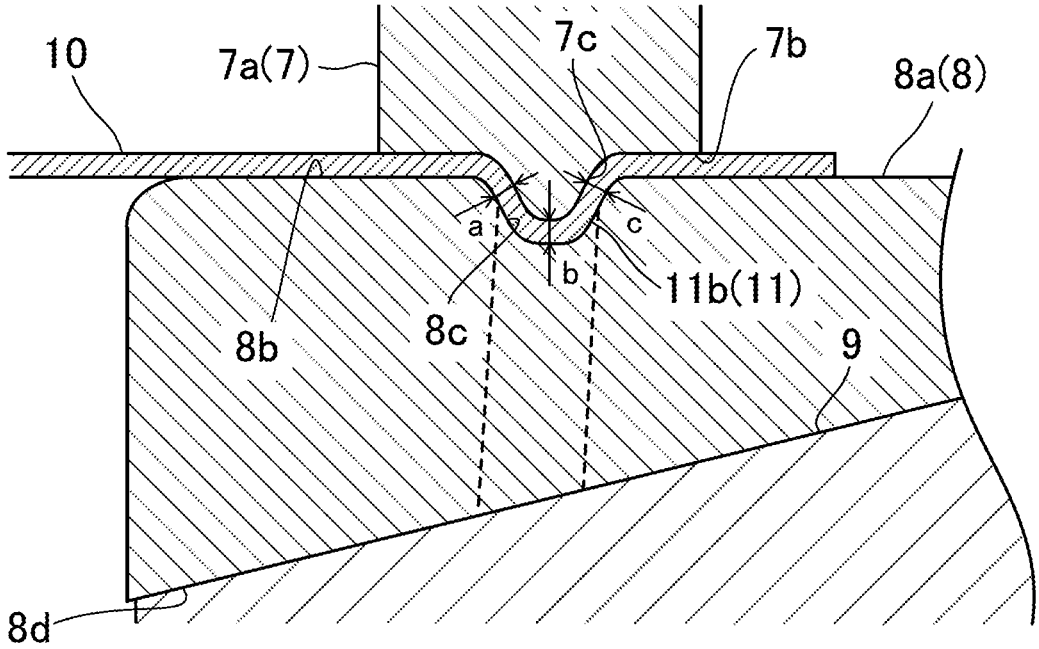
FIG. 10 is an enlarged view of a part X indicated in FIG. 9.

After pressing the outer and inner circumferential surfaces of the metal pipe 10 with the pair of the outer split dies 7*a* and the pair of the inner split dies 8*a*, respectively, when the metal pipe 10 is rotated by 90 degrees about the cylinder center line C1 and the outer split dies 7*a* are again moved toward one another to press the outer circumferential surface of the metal pipe 10 with the outer forming surfaces 7*b* and the inner split dies 8*a* are moved away from one another to press the inner circumferential surface of the metal pipe 10 with the inner forming surfaces 8*b* as shown in FIGS. 9 and 10, the rest of the final formed portion 11*b* is formed on the metal pipe 10 between the rib portions 7*c* and the corresponding recessed groove portions 8*c*, the rest of the final formed portion 11*b* included in the screw thread 11 extending helically, approximately around the circumference, about the cylinder center line C1.

Next, formation of a metal pipe 10 by using the forming apparatus 1 is described in detail.

Figure 3:
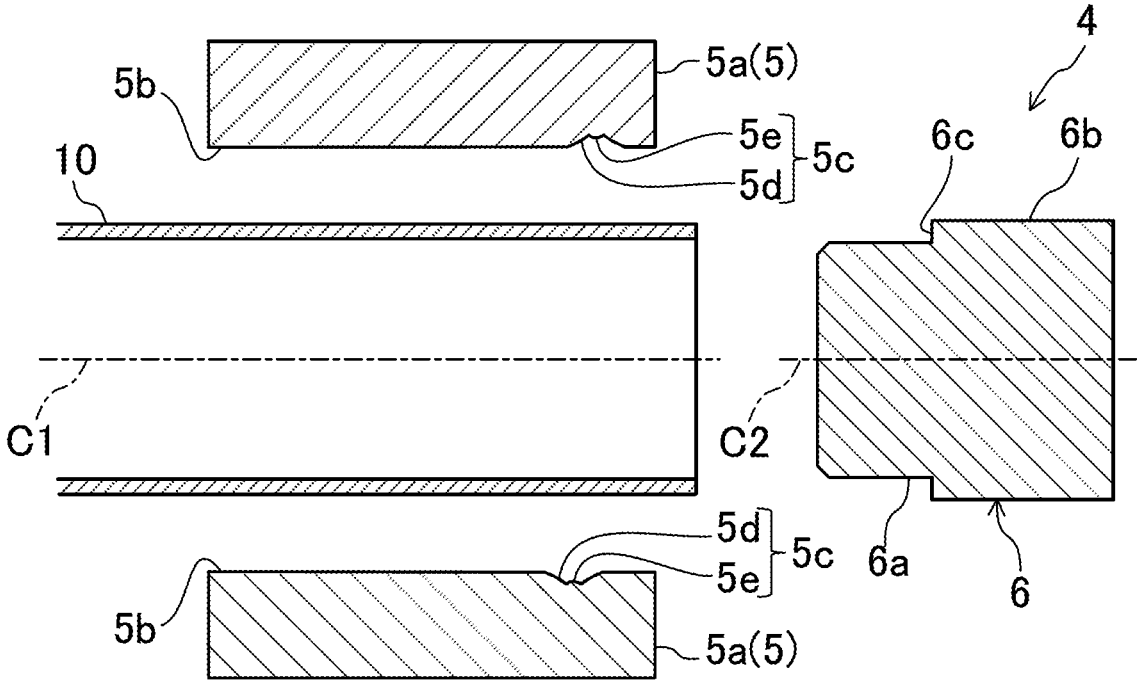
FIG. 3 is a cross-sectional view illustrating a state immediately before forming a primary formed portion on a metal pipe in a first forming operation section.

First, as shown in FIG. 3, in the primary forming unit 4 of the primary forming operation section 2, a metal pipe 10 before forming is placed between the pair of the clamping split dies 5*a* of the clamping die 5 which are being moved away from one another, with its cylinder center line C1 extending horizontally.

Figure 4:
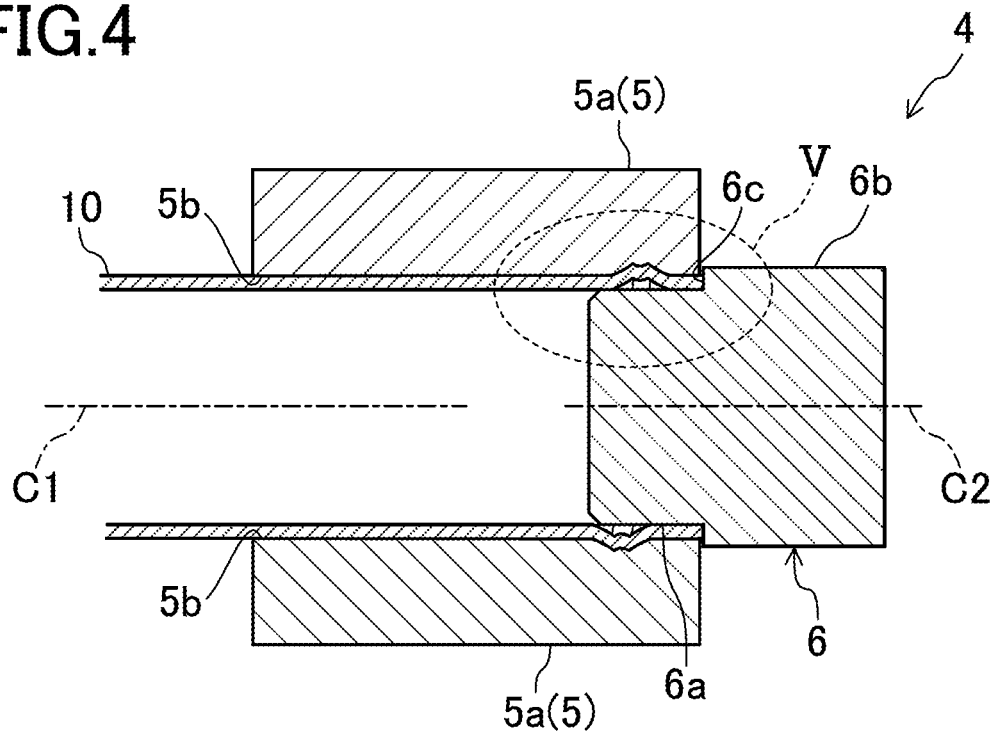
FIG. 4 is a cross-sectional view illustrating a state in the midst of forming the primary formed portion on the metal pipe in the first forming operation section, after the state shown in FIG. 3.

As shown in FIG. 4, the clamping split dies 5*a* are next moved toward one another. The clamping surfaces 5*b* of the clamping split dies 5*a* then contact an outer circumferential surface of the metal pipe 10 from one end to a midsection of the metal pipe 10 to hold the metal pipe 10.

In this operation, the cylinder center line C1 of the metal pipe 10 is aligned with the cylinder center line C2 of the pressing die 6 and spaces Si are formed between the preforming surface portions 5*c* of the clamping surfaces 5*b* of the clamping split dies 5*a* and the outer circumferential surface of the metal pipe 10.

Figure 5:
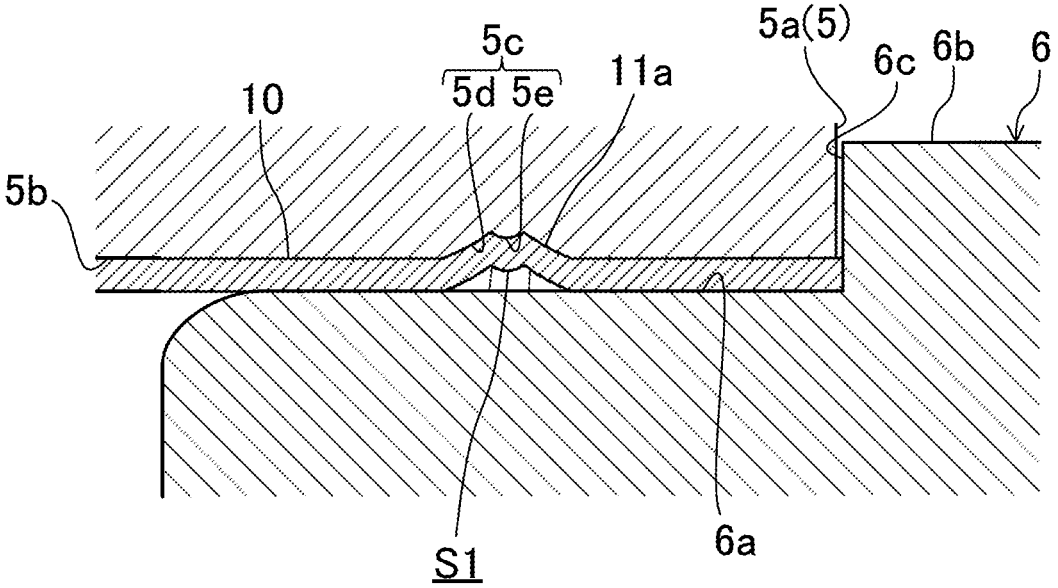
FIG. 5 is an enlarged view of a part V indicated in FIG. 4.

The forward movement of the pressing die 6 then allows the insertion portion 6*a* of the pressing die 6 to be inserted into the metal pipe 10 from the one end of the metal pipe 10, and the pressing portion 6*c* to press an end portion of the metal pipe 10 in a direction of the cylinder center line C1. As shown in FIG. 5, a side wall of the metal pipe 10 that is pressed by the pressing portion 6*c* is then deformed toward the space 51 to conform to the preforming surface portion 5*c* in order to form the primary formed portion 11*a* extending helically about the cylinder center line C1.

Figure 6:
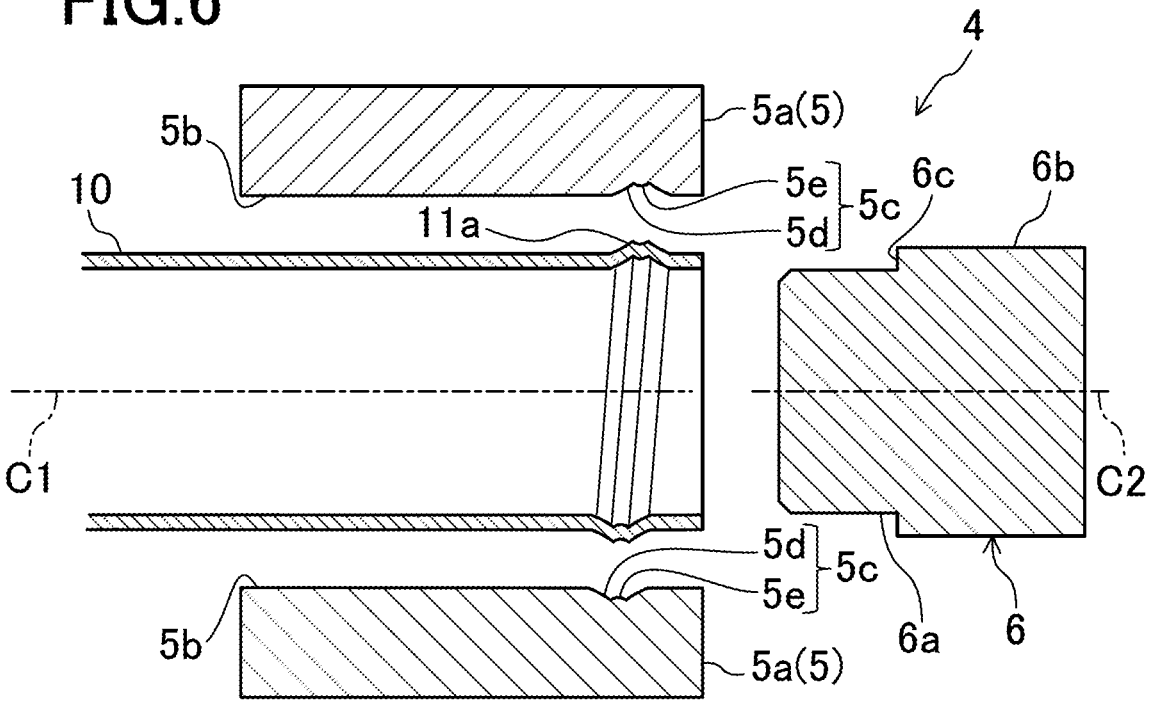
FIG. 6 is a cross-sectional view illustrating a state immediately after forming the primary formed portion on the metal pipe in the first forming operation section, after the state shown in FIG. 4.

Thereafter, as shown in FIG. 6, the pressing die 6 is moved rearward and the clamping split dies 5*a* are moved away from one another to remove, from the primary forming unit 4, the metal pipe 10 including the formed primary formed portion 11*a* to then transfer to the second forming operation section 3.

As shown in FIG. 7, the metal pipe 10 is next placed between the pair of the outer split dies 7*a* of the outer forming die 7 which are being moved away from one another, with its cylinder center line C1 extending horizontally. In this operation, the primary formed portion 11*a* formed on the metal pipe 10 is aligned with the rib portions 7*c* of the respective outer split dies 7*a*.

As shown in FIG. 8, the outer split dies 7*a* are then moved toward one another. The outer forming surfaces 7*b* of the outer split dies 7*a* then press the outer circumferential surface of the metal pipe 10. The inner split dies 8*a* and the slider die 9 are also inserted into the metal pipe 10 and one of the recessed groove portions 8*c* of the one of the inner split dies 8*a* is aligned with the primary formed portion 11*a* of the metal pipe 10 and the recessed groove portion 8*c* of the other of the inner split dies 8*a* is aligned with the primary formed portion 11*a* of the metal pipe 10. The slider die 9 is then slid into the metal pipe 10 along the center line C3. The outer circumferential surface of the slider die 9 is then in sliding contact with the cam surfaces 8*d* of the inner split dies 8*a* to move the inner split dies 8*a* to be spaced away from one another, and the inner forming surfaces 8*b* of the inner split dies 8*a* press an inner circumferential surface of the metal pipe 10. In this operation, the rib portions 7*c* fit in an indentation portion of a tip portion of the primary formed portion 11*a* and deform the primary formed portion 11*a* inwardly of the metal pipe 10.

Thus, when the outer forming surfaces 7*b* of the outer split dies 7*a* press the outer circumferential surface of the metal pipe 10 and the inner forming surfaces 8*b* of the inner split dies 8*a* press the inner circumferential surface of the metal pipe 10, the primary formed portion 11*a* of the metal pipe 10 between the rib portions 7*c* and the corresponding recessed groove portions 8*c* is deformed inwardly of the metal pipe 10 to form part of the final formed portion 11*b* along the rib portions 7*c* and the corresponding recessed groove portions 8*c*.

Subsequently, after the outer split dies 7*a* are moved away from one another and the slider die 9 is moved rearward to move the inner split dies 8*a* toward one another, the metal pipe 10 is rotated by 90 degrees about the cylinder center line C1 and the outer split dies 7*a* are again moved toward one another to press the outer circumferential surface of the metal pipe 10 with the outer forming surfaces 7*b* and the inner split dies 8*a* are moved away from one another to press the inner circumferential surface of the metal pipe 10 with the inner forming surfaces 8*b*, as shown in FIG. 9. The primary formed portion 11*a* of the metal pipe 10 between the rib portions 7*c* and the corresponding recessed groove portions 8*c* is then deformed inwardly of the metal pipe 10 to form the rest of the final formed portion 11*b* along the rib portions 7*c* and the corresponding recessed groove portions 8*c*, thereby completing the final formed portion 11*b* that is the screw thread 11 extending helically, approximately around the circumference, about the cylinder center line C1.

Next, evaluation results of a rate of decrease of plate thickness for a screw thread 11 formed by the method according to the first embodiment of the present disclosure are explained.

Figures 14, 15:
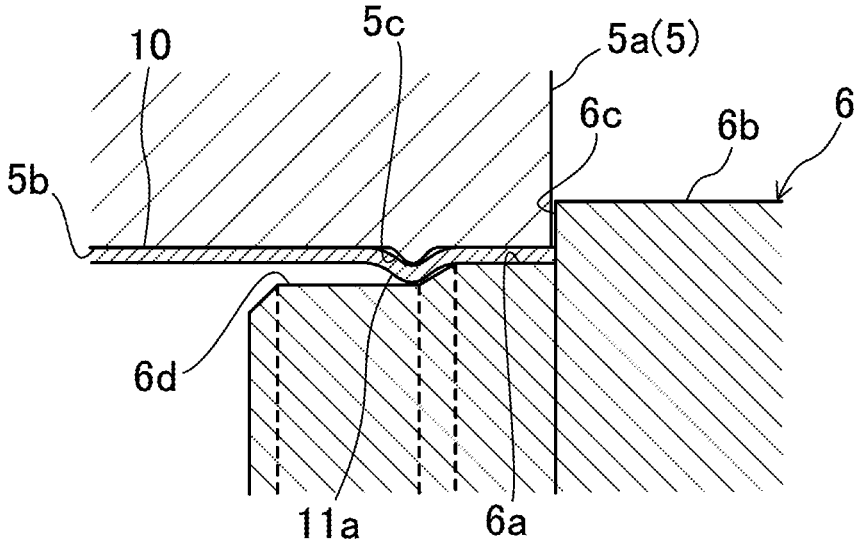
FIG. 14 is an enlarged view of a part XIV indicated in FIG. 13.
FIG. 15 shows a table showing result of studying a rate of decrease of plate thickness for a screw thread of a metal pipe formed by means of a method according to the first embodiment.

FIGS. 15 and 17 show results of calculating a rate of decrease of plate thickness for the screw thread 11 formed by the method according to the first embodiment of the present disclosure and for a screw thread formed by a conventional method as described in Patent document 1. A metal pipe having the screw thread formed by the conventional method and a metal pipe 10 having the screw thread 11 formed by the method according to the first embodiment of the present disclosure were each prepared, and plate thickness was measured at three points a, b, and c (see FIG. 10) in each of four positions A to D located at equal intervals about the cylinder center line C1 to study a percentage of decrease of the plate thickness with respect to the plate thickness of the metal pipe 10 before forming. The rate of decrease of plate thickness equal to or less than 30 percent is determined as absence of problems.

As shown in FIG. 15, when the screw thread 11 was formed by the method according to the first embodiment of the present disclosure, the rate of decrease of plate thickness was equal to or less than 30 percent in all of the measurement points. In contrast, as shown in FIG. 17, when the screw thread 11 was formed by the method according to the conventional embodiment, the rate of decrease of plate thickness exceeded 30 percent in several points and occurrence of lowered rigidity or strength of the metal pipe 10 were observed.

According to the first embodiment of the present disclosure, the pressing movement of the pressing die 6 applies compression force to the metal pipe 10 in the direction of the cylinder center line C1 and thus, a portion of the metal pipe 10, which corresponds to the preforming surface portion 5*c* and in which the screw thread is to be formed, is deformed outwardly of the metal pipe 10 while retaining its plate thickness, in order to provide the primary formed portion 11*a*. Even when the primary formed portion 11*a* of the metal pipe 10 is deformed thereafter by the rib portions 7*c* and the recessed groove portions 8*c* corresponding to one another, an amount of stretch of the primary formed portion 11*a* in the metal pipe 10 in a direction of the plate thickness until the primary formed portion 11*a* is processed to be the final formed portion 11*b* is thus decreased, enabling reduction of lowering in rigidity and strength due to decreased plate thickness.

A direction of deformation of the primary formed portion 11*a* formed by the preforming surface portion 5*c* and a direction of deformation of the final formed portion 11*b* are then opposite, thus canceling residual stresses on the portions to provide good formability. The primary formed portion 11*a* of the metal pipe 10 is thus easier to deform, enabling avoidance of, for example, cracking during the forming to unfailingly form the screw thread 11.

The primary formed portion 11*a* formed by the preforming surface portions 5*c* has a substantially triangular cross section and a tip portion of the primary formed portion 11*a* has an indentation. When the outer forming dies 7 are moved toward the metal pipe 10 after forming the primary formed portion 11*a*, the rib portions 7*c* thus fit in the tip portion of the primary formed portion 11*a*. This reduces variations in forming operation, enabling the shape of the final formed portion 11*b* to be formed with good precision.

Further, the metal pipe 10 is rotated about the cylinder center line C1 to form the final formed portion 11*b* between the outer forming dies 7 and the inner forming dies 8 in two types of postures. Even when the screw thread 11 is shaped to extend helically more than or equal to half of the circumference of the metal pipe 10 about the cylinder center line C1, the screw thread 11 thus can be formed by the pairs of the outer forming dies 7 and the inner forming dies 8, without having multiple forming operations. This enables a low-cost and efficiently forming arrangement.

Second Embodiment of Disclosure

FIGS. 11 to 14 show a forming apparatus 1 for forming by means of a method according to a second embodiment of the present disclosure. The second embodiment differs from the first embodiment only in a forming method in the first forming operation section 2, while being the same as the first embodiment in connection with other aspects. Aspects different from the first embodiment will be only explained below.

The preforming surface portions 5*c* of the clamping surfaces 5*b* of the clamping die 5 in the second embodiment include a rib protruding on a side corresponding to a metal pipe 10 and the rib part has a cross sectional shape smaller than that of the rib portion 7*c*.

The insertion portion 6*a* of the pressing die 6 in the second embodiment includes an interference avoidance portion 6*d* in an approximately front half portion thereof in the forward and rearward directions, the interference avoidance portion 6*d* having an outer diameter further smaller than that of an approximately rear half portion of the insertion portion 6*a* in the forward and rearward directions.

Figure 11:
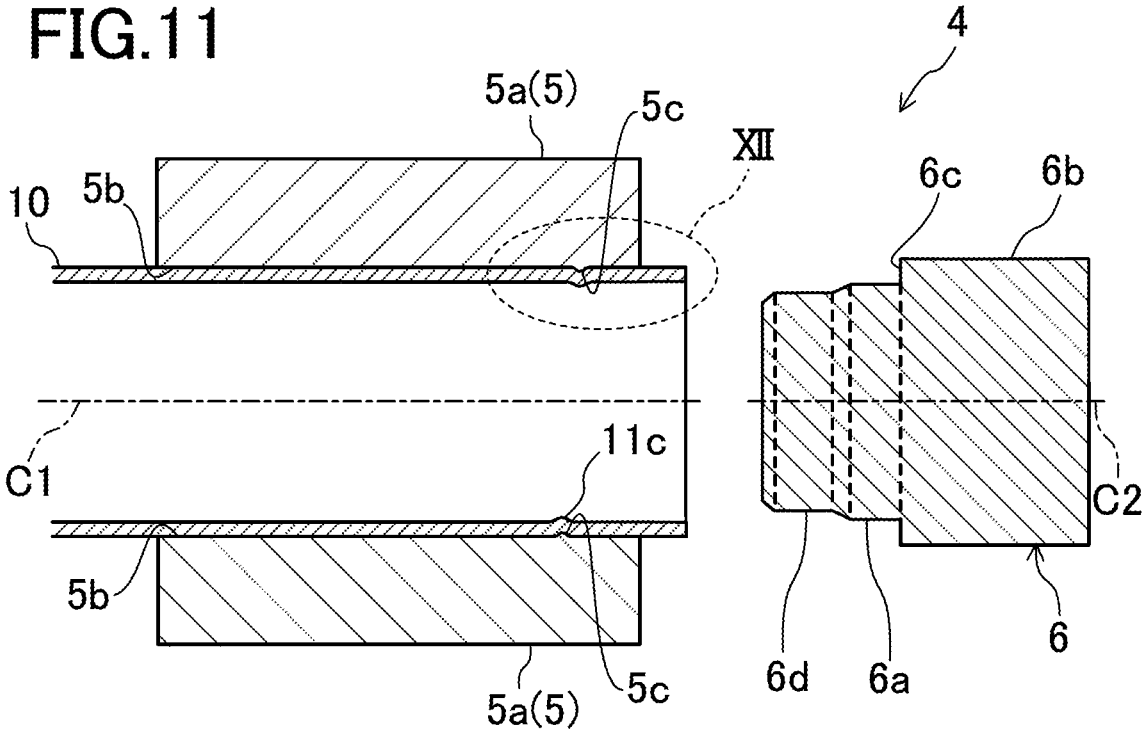
FIG. 11 is a schematic cross-sectional view illustrating a forming apparatus for forming by means of a method according to a second embodiment of the present disclosure, and is a cross-sectional view illustrating a state immediately after starting to form a primary formed portion on a metal pipe in a first forming operation section.
Figure 12:
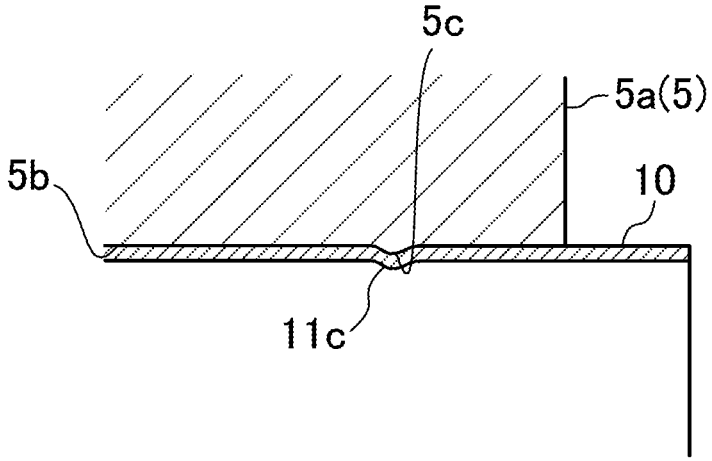
FIG. 12 is an enlarged view of a part XII indicated in FIG. 11.
Figure 13:
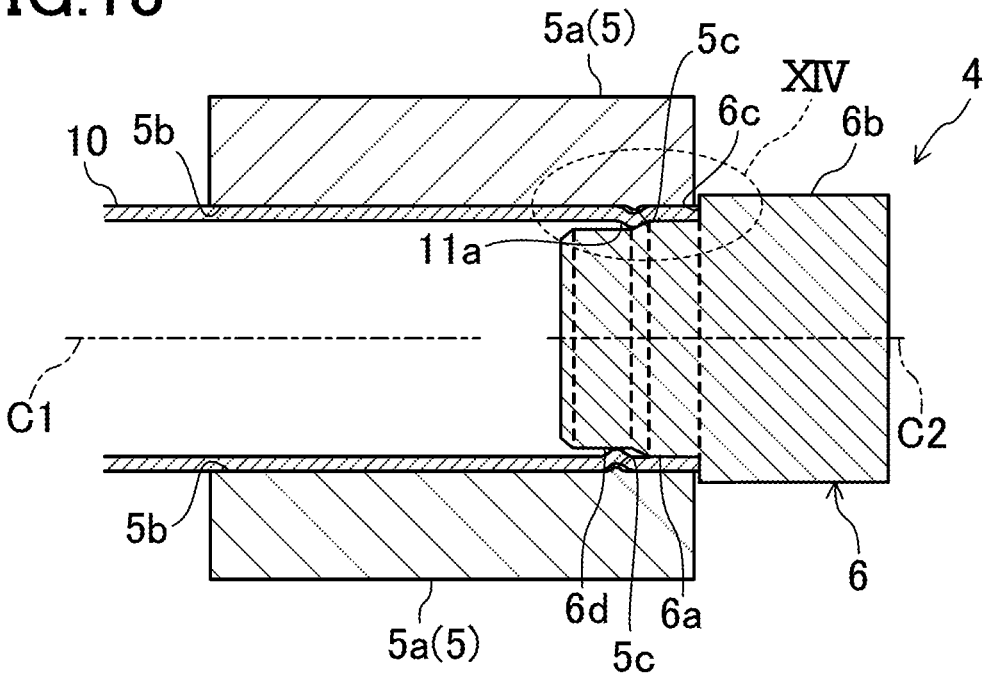
FIG. 13 is a cross-sectional view illustrating a state immediately before finishing forming the primary formed portion on the metal pipe in the first forming operation section, after the state shown in FIG. 11.

When the metal pipe 10 is held by the clamping split dies 5*a* of the clamping die 5, a ribbed preformed portion 11*c* is formed on an inner circumferential surface of the metal pipe 10 by the preforming surface portions 5*c* as shown in FIGS. 11 and 12, the preformed portion 11*c* protruding inwardly of the metal pipe 10 and extending helically. As shown in FIG. 13, when the pressing die 6 is moved forward in a state where the preformed portion 11*c* is formed on the metal pipe 10, the pressing portion 6*c* then presses an end portion of the metal pipe 10 in a direction of the cylinder center line C1. As shown in FIG. 14, a side wall of the metal pipe 10 that is pressed by the pressing portion 6*c* is further deformed inwardly of the metal pipe 10 to be spaced away from the preforming surface portion 5*c*, with the preformed portion 11*c* serving as a starting point, and the primary formed portion 11*a* extending helically about the cylinder center line C1 is formed on the metal pipe 10. In this operation, the primary formed portion 11*a* deformed inwardly of the metal pipe 10 does not contact the pressing die 6 due to the interference avoidance portion 6*d*.

Next, formation of a metal pipe 10 by using the forming apparatus 1 of the second embodiment is described in detail.

First, in the primary forming unit 4 of the primary forming operation section 2, a metal pipe 10 before forming is placed between the pair of the clamping split dies 5*a* of the clamping die 5 which are being moved away from one another, with its cylinder center line C1 extending horizontally, and thereafter, the clamping split dies 5*a* are moved toward one another. As shown in FIGS. 11 and 12, the clamping surfaces 5*b* of the clamping split dies 5*a* then contact an outer circumferential surface of the metal pipe 10 from one end to a midsection of the metal pipe 10 to hold the metal pipe 10, and the ribbed preforming surface portions 5*c* deform a side wall of the metal pipe 10 inwardly of the metal pipe 10 to form the ribbed preformed portion 11*c* extending helically.

Subsequently, as shown in FIGS. 13 and 14, forward movement of the pressing die 6 allows the insertion portion 6*a* of the pressing die 6 to be inserted into the metal pipe 10 from the one end of the metal pipe 10, and the pressing portion 6*c* to press an end portion of the metal pipe 10 in a direction of the cylinder center line C1. The side wall of the metal pipe 10 that is pressed by the pressing portion 6*c* is then further deformed inwardly of the metal pipe 10 to be spaced away from the preforming surface portions 5*c*, with the preformed portion 11*c* serving as a starting point, in order to form the primary formed portion 11*a* extending helically about the cylinder center line C1.

Formation of the final formed portion 11*b* in the second forming operation section 3 of the second embodiment is the same as that of the first embodiment and detailed explanation is thus omitted.

Next, evaluation results of a rate of decrease of plate thickness for a screw thread 11 formed by the method according to the second embodiment of the present disclosure are explained.

FIG. 16 shows results of calculating a rate of decrease of plate thickness for the screw thread 11 formed by the method according to the second embodiment of the present disclosure. A metal pipe 10 having the screw thread 11 formed by the method according to the second embodiment of the present disclosure was prepared, and plate thickness was measured at three points a, b, and c (see FIG. 10) in each of four positions A to D located at equal intervals about the cylinder center line C1 to study a percentage of decrease of the plate thickness with respect to the plate thickness of the metal pipe 10 before forming. The rate of decrease of plate thickness equal to or less than 30 percent is determined as absence of problems.

As shown in FIG. 16, when the screw thread 11 was formed by the method according to the second embodiment of the present disclosure, the rate of decrease of plate thickness was equal to or less than 30 percent in all of the measurement points and it was observed that rigidity or strength of the metal pipe 10 was at a sufficient level.

According to the second embodiment of the present disclosure, a direction of deformation of the primary formed portion 11*a* formed by the preforming surface portions 5*c* and a direction of deformation of the final formed portion 11*b* are the same. Thus, when the primary formed portion 11*a* is deformed into the final formed portion 11*b* between the rib portions 7*c* of the outer forming dies 7 and the corresponding recessed groove portions 8*c* of the inner forming dies 8, force applied to the metal pipe 10 can be reduced as compared to that of the arrangement as in the first embodiment, enabling improvement of processing efficiency.

In the first and second embodiments of the present disclosure, the outer forming surfaces 7*b* of the outer forming dies 7 include the rib portions 7*c* and the inner forming surfaces 8*b* of the inner forming dies 8 include the recessed groove portions 8*c*, in order to form the final formed portion 11*b* on the metal pipe 10; however, the outer forming surfaces 7*b* of the outer forming dies 7 may include the recessed groove portions 8*c* and the inner forming surfaces 8*b* of the inner forming dies 8 may include the rib portions 7*c*, in order to form the final formed portion 11*b* on the metal pipe 10.

INDUSTRIAL APPLICABILITY

The present disclosure is suitable for a method for forming a screw thread on a metal pipe.

DESCRIPTION OF REFERENCE CHARACTERS

5 Clamping die
5*b* Clamping surface
5*c* Preforming surface portion
5*d* Inclined side surface portion
5*e* Curved surface portion
6 Pressing die
7 Outer forming die
7*a* Outer split die
7*b* Outer forming surface
7*c* Rib portion
8 Inner forming die
8*a* Inner split die
8*b* Inner forming surface
8*c* Recessed groove portion
10 Metal pipe
11 Screw thread
11*a* Primary formed portion
11*b* Final formed portion
C1 Cylinder center line

The invention claimed is:

1. A method for forming a screw thread on a metal pipe, in which a screw thread extending about a cylinder center line of the metal pipe is formed on the metal pipe, the method comprising the steps of:

holding the metal pipe using a clamping die having a clamping surface including a preforming surface portion corresponding to the screw thread, and thereafter pressing an end portion of the metal pipe with a pressing die in a direction of the cylinder center line to thereby form a primary formed portion on the metal pipe, the primary formed portion having a shape corresponding to the preforming surface portion and extending helically about the cylinder center line; and subsequently, aligning either one of a rib portion or a recessed groove portion provided on an outer forming surface of an outer forming die with the primary formed portion, the outer forming surface curved to correspond to an outer circumferential surface of the metal pipe, the rib portion or the recessed groove portion having a shape corresponding to the screw thread, and thereafter pressing the outer circumferential surface of the metal pipe with the outer forming surface by moving the outer forming die toward the cylinder center line, while inserting an inner forming die into the metal pipe and aligning another of the rib portion or the recessed groove portion provided on an inner forming surface of the inner forming die with the primary formed portion, the inner forming surface curved to correspond to an inner circumferential surface of the metal pipe, and thereafter pressing the inner circumferential surface of the metal pipe with the inner forming surface by moving the inner forming die away from the cylinder center line, to thereby form a final formed portion on the metal pipe between the rib portion and the recessed groove portion, the final formed portion serving as the screw thread.

2. The method of claim 1, wherein the preforming surface portion includes a recessed strip that is open on a side corresponding to the metal pipe, and the outer forming surface of the outer forming die includes the rib portion and the inner forming surface of the inner forming die includes the recessed groove portion.

3. The method of claim 2, wherein the preforming surface portion includes a pair of inclined side surface portions and a curved surface portion, the pair of inclined side surface portions extending away from the outer circumferential surface of the metal pipe held by the clamping die, and opposing one another to be progressively closer to one another as extending away, the curved surface portion belt-shaped to connect extension ends of the inclined side surface portions and gently curved such that its midsection in a width direction is located on a metal pipe side.

4. The method of claim 1, wherein the preforming surface portion includes a rib protruding on a side corresponding to the metal pipe, and the outer forming surface of the outer forming die includes the rib portion and the inner forming surface of the inner forming die includes the recessed groove portion.

5. The method of claim 1, wherein the outer forming die includes a pair of outer split dies movable toward and away from one another, and the outer split dies have a length more than or equal to one-fourth of a circumference of the metal pipe, the inner forming die includes a pair of inner split dies being movable toward and away from one another and corresponding to the respective outer split dies, and the method further includes, after placing the metal pipe between the outer split dies, pressing the outer circumferential surface of the metal pipe with outer forming surfaces of the outer split dies by moving the outer split dies toward one another while pressing the inner circumferential surface of the metal pipe with inner forming surfaces of the inner split dies by moving the inner split dies away from one another and thereafter, rotating the metal pipe by 90 degrees about the cylinder center line, and subsequently, pressing the outer circumferential surface of the metal pipe with the outer forming surfaces of the outer split dies by moving the outer split dies toward one another while pressing the inner circumferential surface of the metal pipe with the inner forming surfaces of the inner split dies by moving the inner split dies away from one another, to thereby form the final formed portion.

* * * * *